United States Patent [19]

Besecker

[11] 4,345,544

[45] Aug. 24, 1982

[54] APPARATUS FOR FORMING LINES ON AN ATHLETIC PLAYING FIELD OR COURT

[76] Inventor: Jack J. Besecker, 247 N. High St., Bradford, Ohio 45308

[21] Appl. No.: 238,080

[22] Filed: Feb. 25, 1981

[51] Int. Cl.[3] ..... B05C 5/00; B05C 17/00

[52] U.S. Cl. ..... 118/108; 118/301; 118/305

[58] Field of Search ..... 118/415, 413, 108, 305, 118/301; 401/138, 139, 193, 188; 239/150

[56] References Cited

U.S. PATENT DOCUMENTS

| | | | |
|---|---|---|---|
| 856,641 | 6/1907 | Hyman . | |
| 880,351 | 2/1908 | Barrier . | |
| 1,561,553 | 11/1925 | Lindsay | 239/150 |
| 1,651,271 | 11/1927 | Hann . | |
| 2,076,172 | 4/1937 | Bowden | 118/305 X |
| 3,145,411 | 8/1964 | Fischer et al. | 401/188 |
| 3,695,222 | 10/1972 | Arrant | 118/207 |
| 3,964,835 | 6/1976 | Eigenmann | 118/108 X |

*Primary Examiner*—John P. McIntosh

*Attorney, Agent, or Firm*—Jacox & Mackstroth

[57] ABSTRACT

Apparatus for applying a line to the surface of an athletic field or the like. The apparatus includes a movable discharge housing to which a liquid lining material is conducted. The discharge housing has a guide wheel attached thereto for rotation with respect thereto. The guide wheel is adapted to travel along a rope which is stretched taut over a portion of the surface of the athletic field so that a line is applied to the portion of the surface of the field adjacent the rope as the housing is moved along the rope, guided by the travel of the guide wheel along the rope.

4 Claims, 4 Drawing Figures

FIG-1
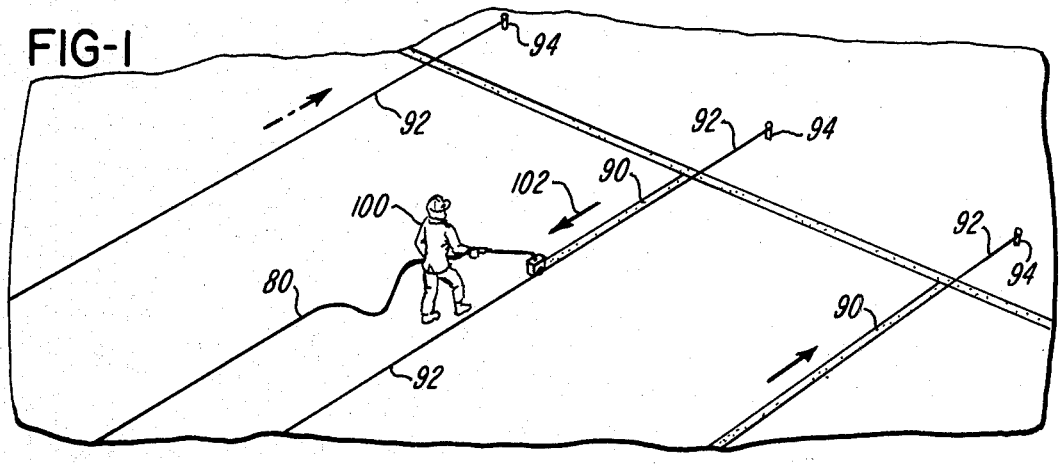
FIG-2
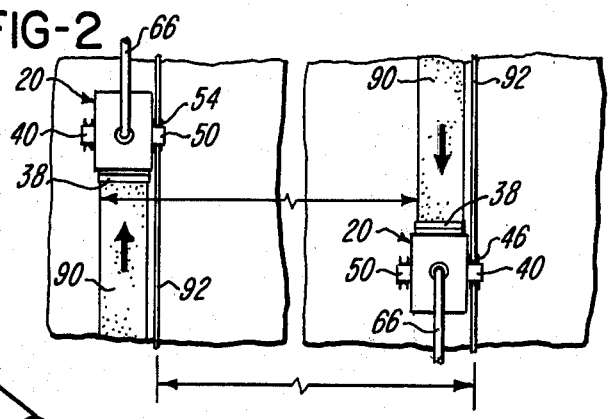
FIG-3
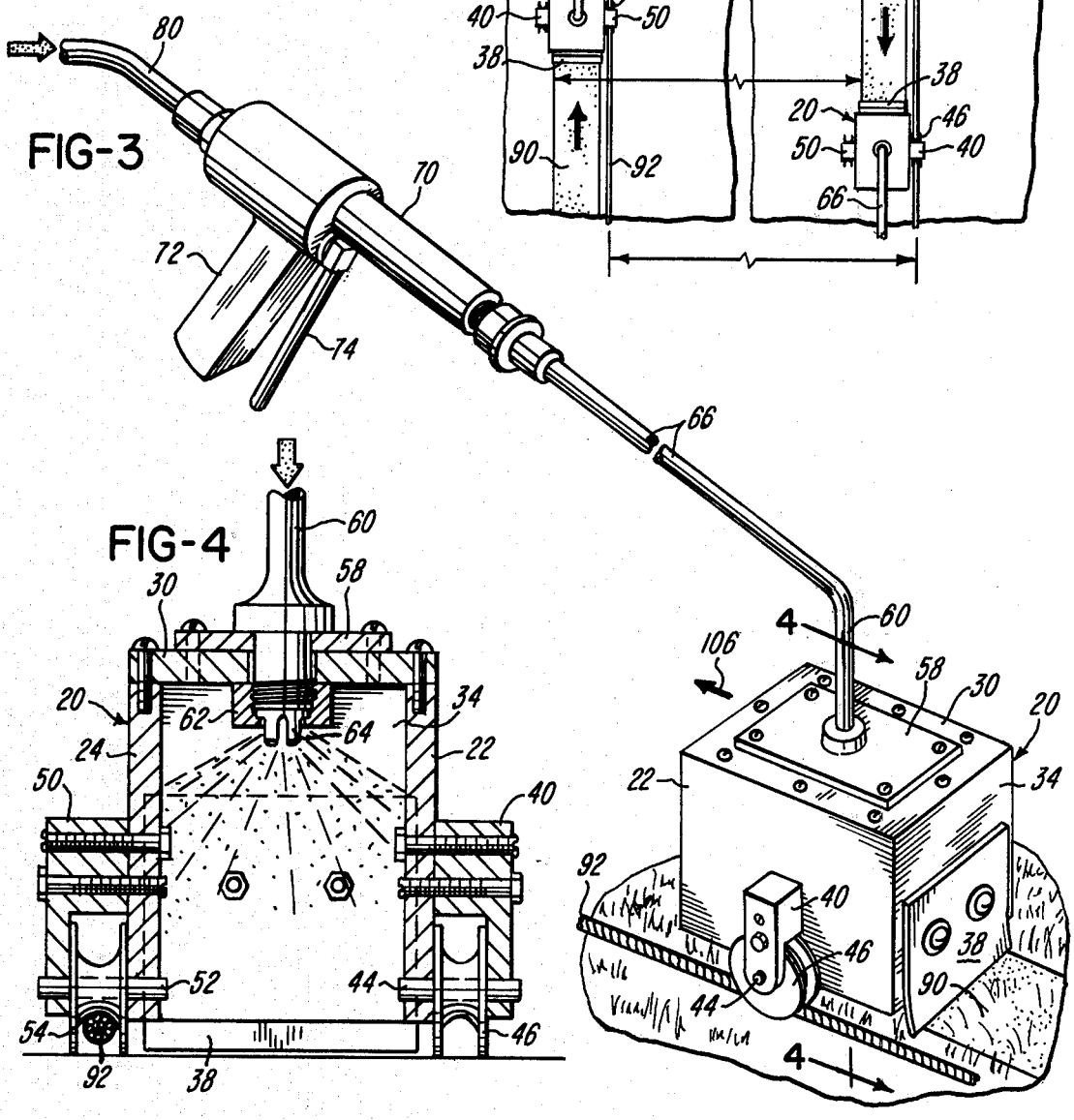
FIG-4

APPARATUS FOR FORMING LINES ON AN ATHLETIC PLAYING FIELD OR COURT

BACKGROUND OF THE INVENTION

Most types of athletic playing fields and courts must have lines applied thereto for marking boundaries and areas or regions of the field or court. One problem which has existed is that of applying a line which is straight and accurately located.

Another problem which has existed is that of applying such lines easily and rapidly.

Another problem which has existed is that of applying such lines to grass fields or courts in that it has been found that lining material may not adequately cover the blades of grass during the applying of the lining material.

It is therefore an object of this invention to provide apparatus for forming lines on an athletic playing field or court in which the apparatus is capable of rapidly and accurately applying lines.

It is another object of this invention to provide such apparatus which is capable of adequately applying lining material to blades of grass.

Other objects and advantages of this invention reside in the construction of parts, the combination thereof, the method of production, and the mode of operation, as will become more apparent from the following description.

BRIEF DESCRIPTION OF THE VIEWS OF THE DRAWING

FIG. 1 is a fragmentary perspective view illustrating use of the apparatus of this invention for applying lines to an athletic playing field, such as a football playing field.

FIG. 2 is a plan view, drawn on a larger scale than FIG. 1, illustrating use of the apparatus in forming two adjacent parallel lines on a field.

FIG. 3 is a perspective view, drawn on a larger scale than FIG. 2, showing apparatus of this invention as the apparatus forms a line on a playing field.

FIG. 4 is an enlarged sectional view taken substantially on line 4—4 of FIG. 3.

DETAILED DESCRIPTION OF THE INVENTION

Apparatus of this invention as best shown in FIGS. 3 and 4 comprises a discharge housing 20 which has opposed side walls 22 and 24, separated by a roof 30. The discharge housing 20 has opposed end walls 34. Attached to one end wall 34 at the lower portion thereof is a flexible flap member 38 which extends to a position below the wall 34.

Attached to the side wall 22 is a bracket 40 which carries a shaft 44 which rotatably carries a grooved wheel 46. Attached to the side wall 24 is a bracket 50 which carries a shaft 52 which rotatably carries a grooved wheel 54.

Attached upon the roof 30 is a plate 58. Extending through the plate 58 and the roof 30 is a stem 60, the lower portion of which is threadedly attached to a connection block 62 which is secured to the inner surface of the roof 30. The lower end of the stem 60 has a spray nozzle 62 within the discharge housing 20.

Attached to the stem 60 and extending angularly upwardly therefrom is a rigid tube 66, of any suitable length. The upper end of the rigid tube 66 is attached to a valve housing 70, within which there is a valve, not shown. The valve housing 70 has a support handle 72 and a pivotally movable actuator rod 74.

Connected to the portion of the valve housing 70 opposite the rigid tube 66 is a long flexible hose 80 or the like. The flexible hose 80 is of any suitable length, preferably of a length at least equal to the length of any line to be formed by the apparatus. The end of the flexible hose 80 opposite the end which is attached to the valve housing 70 is joined to a pump and supply tank, not shown. Preferably, the supply tank contains a liquid, such as paint or the like.

OPERATION

When it is desired to form a line, such as a line 90 shown in FIG. 3, a guide rope 92 is stretched taut between two stakes 94. The guide rope 92 is positioned immediately above the portion of the field upon which a line 90 is to be formed. One of the wheels 46 or 54 is positioned over the guide rope 92 for guided rotative movement therealong. FIG. 3 shows the wheel 54 positioned over a part of the guide rope 92 for rotative movement therealong. FIG. 1 shows three stakes 94 and three guide ropes 92. Each stake 94 has an end of a guide rope 92 attached thereto and extending therefrom to a stake 94 at the opposite end of the guide rope 92. A pump, not shown, at the end of the flexible hose 80 pumps liquid, such as paint from the supply tank, not shown. The liquid flows through the flexible hose 80 to the valve housing 70. The valve, not shown, within the valve housing 70 is normally closed and does not normally permit flow of liquid through the valve housing 70. The support handle 72 of the valve housing 70 is manually grasped to support the valve housing 70.

When it is desired to form a line 90, the actuator rod 74 is pivotally moved to open the valve within the valve housing 70 and to permit flow of liquid into the rigid tube 66. The liquid flows through the rigid tube 66 and through the stem 60 and into the discharge housing 20. The liquid is sprayed into the discharge housing 20 from the spray nozzle 64. The liquid then flows downwardly within the discharge housing 20 and flows from the discharge housing 20 through the open lower portion of the discharge housing 20. As the liquid flows from the discharge housing 20, the valve housing 70 is moved along the guide rope 92. An operator 100 who operates the apparatus walks backwardly, as illustrated by an arrow 102 in FIG. 1, and as the discharge housing 20 is moved in a direction represented by an arrow 106 in FIG. 3.

The rigid tube 66, attached to the discharge housing 20 and to the valve housing 70, serves as a connection means between the valve housing 70 and the discharge housing 20 for movement of the discharge housing 20. As the liquid flows from the discharge housing 20, the liquid falls upon the ground and upon blades of grass which are immediately below the discharge housing 20. As the discharge housing 20 is moved along the guide rope 92 to form a line adjacent the guide rope 92, the liquid which falls from the discharge housing 20 is smoothed and spread evenly upon the blades of grass and upon the ground by the flap member 38 which is at the trailing portion of the discharge housing 20.

Due to the fact that the wheels 46 and 54 are positioned on opposed sides of the discharge housing 20, either the wheel 46 or the wheel 54 is used to follow the guide rope 92. The guide ropes 92 are spaced apart in parallel relationship, as illustrated in FIG. 1. The spacing between adjacent parallel guide ropes 92 is accurately determined. Thus, in using the proper wheel 46 or 54 on the proper side of the guide rope 92, the spacing between the lines 90 is maintained precisely.

Although the preferred embodiment of the line forming apparatus of this invention has been described, it will be understood that within the purview of this invention various changes may be made in the form, details, proportion and arrangement of parts, the combination thereof, and the mode of operation, which generally stated consist in apparatus within the scope of the appended claims.

The invention having thus been described, the following is claimed:

1. Apparatus for applying a line to the surface of an athlete field or the like in which a rope is stretched taut across a portion of the surface at the location of the desired line, and in which liquid lining material is pumped from a source thereof through an elongate flexible hose, comprising:

valve structure joined to the elongate flexible hose, an elongate rigid tube having an end thereof attached to the valve structure, a housing positioned adjacent the surface and joined to the opposite end of the elongate rigid tube, the housing having a pair of opposed side walls and a pair of opposed end walls, one of the end walls being a forward end wall and the other end wall being a trailing end wall, the housing having an opening in the bottom portion thereof, a pair of guide and support wheels, there being a guide and support wheel attached to each of the side walls of the housing for rotation with respect thereto, each of the guide and support wheels being adapted to engage the rope and to support the housing as the housing is supported by both of the guide and support wheels and as the rope is engaged by one of the guide and support wheels and guides movement thereof and thus guides movement of the housing along the rope, the flexible hose conducting liquid lining material to the valve structure, the valve structure controlling flow of the liquid lining material to the elongate rigid tube, the liquid lining material flowing through the elongate rigid tube to the housing, the liquid lining material flowing within the housing between the side walls and between the end walls, the liquid lining material flowing downwardly from the housing through the opening in the bottom portion of the housing, the liquid lining material flowing upon the surface and forming a line upon the surface as one of the guide and support wheels is moved along the rope and as the movement of the housing is guided by the guide and support wheel, the elongate rigid tube serving as a handle for movement of the housing.

2. The apparatus of claim 1 which includes a flexible flap attached to the trailing end wall of the housing and extending therebelow to engage portions of the surface to spread the liquid lining material.

3. The apparatus of claim 1 in which the housing has a roof, the rigid tube being in communication with the roof of the housing for flow of liquid lining material into the housing through the roof.

4. The apparatus of claim 1 in which the housing has an open bottom portion, the liquid lining material flowing from the housing through the open bottom portion of the housing.

* * * * *